US008950309B1

(12) United States Patent
Calvert

(10) Patent No.: US 8,950,309 B1
(45) Date of Patent: Feb. 10, 2015

(54) EXPLOSIVE TANK BARREL BLOCKER

(71) Applicant: ETBB Associates, Trustee for Explosive Tank Barrel Blocker CRT Trust, Manassas, VA (US)

(72) Inventor: S. Mill Calvert, Manassas, VA (US)

(73) Assignee: ETBB Associates, Manassas, VA (US), Trustee for Explosive tank barrel blocker CRT Trust ( * ) Notice: Subject to any disclaimer, the term of this patent is extended or adjusted under 35 U.S.C. 154(b) by 0 days.

(21) Appl. No.: 14/298,649

(22) Filed: Jun. 6, 2014

(51) Int. Cl.
*F41A 1/04* (2006.01)
*F41H 11/16* (2011.01)
*F42D 5/04* (2006.01)

(52) U.S. Cl.
CPC *F41H 11/16* (2013.01); *F42D 5/04* (2013.01); *Y10S 901/01* (2013.01)
USPC ..... 89/7; 901/1

(58) Field of Classification Search
CPC ..... F41H 11/16; F41H 7/005; F41H 11/32; F42B 23/00; F42D 5/04
USPC ..... 901/1
See application file for complete search history.

(56) References Cited

U.S. PATENT DOCUMENTS

| | | | | |
|---|---|---|---|---|
| 1,388,545 | A * | 8/1921 | Bohan | 175/19 |
| 1,407,969 | A * | 2/1922 | Wickersham | 180/6.5 |
| 2,478,098 | A | 8/1949 | Hansen | |
| 2,923,323 | A | 2/1960 | Franck | |
| 3,086,465 | A * | 4/1963 | De Montfort | 102/301 |
| 3,395,641 | A * | 8/1968 | Frost | 102/301 |
| 4,522,129 | A * | 6/1985 | Jerberyd | 104/138.1 |
| 4,932,831 | A * | 6/1990 | White et al. | 414/732 |
| 5,171,924 | A | 12/1992 | Honey et al. | |
| 5,289,653 | A | 3/1994 | Szebeni et al. | |
| 5,315,778 | A | 5/1994 | Wolford | |
| 5,450,685 | A | 9/1995 | Peterson | |
| 2009/0030562 | A1* | 1/2009 | Jacobsen et al. | 701/2 |
| 2009/0223355 | A1* | 9/2009 | Manders | 89/1.13 |
| 2011/0266076 | A1* | 11/2011 | Morey et al. | 180/9.32 |

* cited by examiner

*Primary Examiner* — Samir Abdosh
(74) *Attorney, Agent, or Firm* — Louis Ventre, Jr.

(57) ABSTRACT

A self-propelled explosive system is configured to fit within a barrel mounted on a tank. The system includes: a carrier body defining an interior volume; an explosive within the interior volume; a wheel extending from the carrier body to propel the system to a position within the barrel; a foot extensible from the carrier body, preferably so as to hydraulically lock the system in place within the barrel; a proximity fuse at the front end and the rear end of the carrier body to set off the explosive if tampering is detected; a motor operably connected to the wheel to rotate the wheel and propel the carrier body to a desired position within the barrel and to extend the foot from the carrier body to press against the inner wall of the barrel and lock the carrier body in place.

3 Claims, 2 Drawing Sheets

EXPLOSIVE TANK BARREL BLOCKER

TECHNICAL FIELD

In the field of ammunition and explosives, a self-propelled system for installing an explosive device within a gun barrel of a tank.

BACKGROUND ART

In the art and science of warfare, one of the most important pieces of equipment is the tank, which is a heavy armored fighting vehicle carrying guns and typically moving on a continuous articulated metal track. The number of tanks deployed by an army and the quantity of heavy shells the tanks can fire is often the decisive factor in the outcome of a military engagement.

Tank technology has mostly focused on the armor plate strength of the tank, and the size and capacity of the shells it can fire. In World War II, the German Panzer tank was far superior to the armor plating and firepower of the American tank. A German Panzer tank could sit and pick off numerous allied light tanks: One after the other. The primary reason that America was able to defeat German Panzers, is because Germany could only produce about 1,300 of these tanks during the war, while America was able to mass produce about 50,000 tanks.

Even though the Panzer was a superior tank, the Russian T-34 tank proved to be superior to Germany's tanks. The T-34 is credited with forcing the Germans to adopt new, heavier designs such as the Panther and Tiger I. Hitler wanted a much larger armored tank with massive firepower. Hitler commissioned Ferdinand Porsche from the car company to develop this massive tank for him, which is a super-heavy tank completed in late 1944, so close to the end of the war, that only two of them had been built.

Hitler's massive tank was commonly called the Maus (Mouse) and was designed with a hull front armor that was 220 millimeters (8.7 in) thick, sides and rear of the hull that were up to 190 millimeters (7.5 in) thick. The Maus turret armor was even thicker. The turret front was up to 220 millimeters (8.7 in) and the sides and rear 200 millimeters (7.9 in). The mantlet was 250 millimeters (9.8 in), and combined with the turret armor behind, the protection level at that section was even higher. Many considered that the Maus design was based on "tunnel vision technology" because of its focus on armor plate strength, barrel size and shell capacity. The planned weight of the Maus with all that armor was 188 tons. This compared to Germany's earlier Tiger II heavy tank, first used in combat during the Normandy campaign on 11 Jul. 1944, weighing 68 tons and to the U.S. M3 tank weighing in at about 16 tons.

SUMMARY OF INVENTION

A self-propelled explosive system is configured to fit within a barrel mounted on a tank. The system includes a carrier body defining an interior volume. The carrier body has a shape that fits within the barrel. The system includes an explosive within the interior volume of the carrier body. The system includes a wheel extending from the carrier body that has traction against the inner wall of the barrel so as to be able to propel the system to a position with the barrel. The system includes a foot extensible from the carrier body, preferably so as to hydraulically lock the system in place within the barrel. The system includes a proximity fuse at the front end and the rear end of the carrier body, which is connected to the explosive so that once the proximity fuse is activated, any object moved to within a specified distance from the proximity fuse will ignite the explosive. The system includes a motor operably connected to the wheel to rotate the wheel and propel the carrier body to a desired position within the barrel. The motor is configured to extend the foot from the carrier body to press against the inner wall of the barrel and lock the carrier body in place. The system may further include an antenna operable to receive radio-frequency signals that control the operation or activation of components within the system.

TECHNICAL PROBLEM

The technical problem is a need to answer the question: What tank technology can be used to enable a single soldier to stop a tank easily and render it useless to the enemy. If a single soldier had such tank technology, it would no longer matter how thick the tank's armor platting was or how large the caliber of the barrel was, because the tank could instantly be made useless. Such technology would change the outcome of military campaigns and it would no longer matter if the enemy had a far superior tank.

SOLUTION TO PROBLEM

The solution is an explosive tank barrel blocker, which has now brought this overlooked tank technology into the hands of the single soldier. Now a very small, lightweight device that can be carried in a soldier's backpack can render the largest and most powerful tank completely useless. If the soldier covertly installs this device at night when no one is watching, he can render an entire fleet of enemy tanks useless and the enemy will have no idea until they take the tanks into battle and attempt to fire them. The enemy will then find out that their tanks are not only useless, but are also a great danger to their own troops.

The explosive tank barrel blocker works by being an obstruction in the barrel and by having a high explosive that can be triggered by an attempt to remove it or by remotely triggering the explosive with a radiofrequency (RF) remote control. The explosive tank barrel blocker may be inserted into the end of the tank barrel and then by automated preprogrammed control move to a position, lock itself in place in the barrel and then activate a proximity fuse to prevent any attempt to remove it. Such automation may be a button activated prior to placing it in the barrel, or activated using a small RF remote control device, much like a garage door opener. The RF remote control device may be used to cause a motorized wheel or set of wheels to drive the device into the tank barrel.

If the explosive tank barrel blocker is not fully automated, the small RF remote control device could be used to activate a hydraulic mechanism that will push out a foot, or ideally a pair of opposing feet, to compress against the inside of the tank barrel to lock in and hold the device tightly in position. The control device could then turn on, or activate, proximity fuses at each end of the explosive tank barrel blocker to arm the explosive tank barrel blocker against attempts to remove it. If the proximity fuses are either touched or impacted, or if they sense movement within a short distance away, they could be set to explode all of the C-4 or high explosive stored inside of the device.

ADVANTAGEOUS EFFECTS OF INVENTION

If the enemy does not know that the explosive tank barrel blocker is present within the barrel of his tank, then his tank will explode when he tries to fire. If the enemy knows the explosive tank barrel blocker is in his barrel, it will explode if he in anyway tries to remove it from the barrel. Ideally, the explosive tank barrel blocker could only be safely removed by use of the small RF remote control device, which preferably uses an encrypted RF code. The small RF remote control device could deactivate the triggers for the high explosive and also release the hydraulic foot.

The explosive tank barrel blocker is a small, inexpensive device that has now changed the entire art and science of tank warfare. Imagine the Battle of the Bulge or any of the famous tank battles in history and think what would have been the outcome if none of the tanks could have fired a single shot.

The explosive tank barrel blocker is a new technology that will cause great victories for the military that has it to use.

BRIEF DESCRIPTION OF DRAWINGS

The drawings illustrate preferred embodiments of the explosive tank barrel blocker according to the disclosure. The reference numbers in the drawings are used consistently throughout. New reference numbers in FIG. 2 are given the 200 series numbers. Similarly, new reference numbers in each succeeding drawing are given a corresponding series number beginning with the figure number.

DESCRIPTION OF EMBODIMENTS

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized and structural, and operational changes may be made, without departing from the scope of the present invention.

Figure 1:
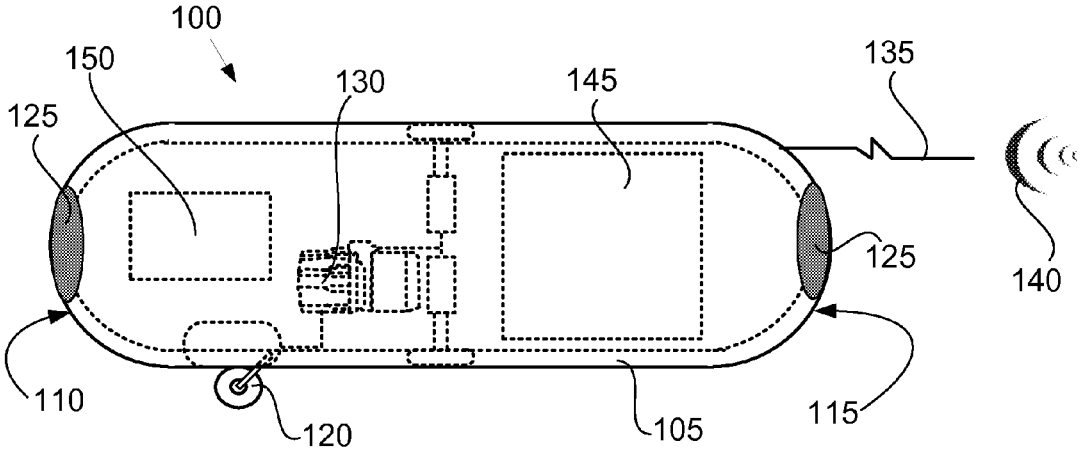
FIG. 1 is a side elevation view of a preferred embodiment of the explosive tank barrel blocker with two extensible feet in a retracted position.
Figure 2:
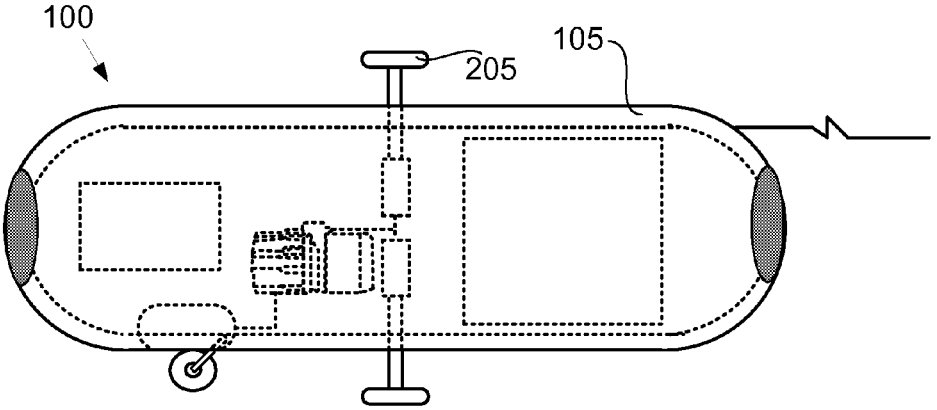
FIG. 2 is a side elevation view of the embodiment of FIG. 1 with two extensible feet in an extended position.
Figure 3:
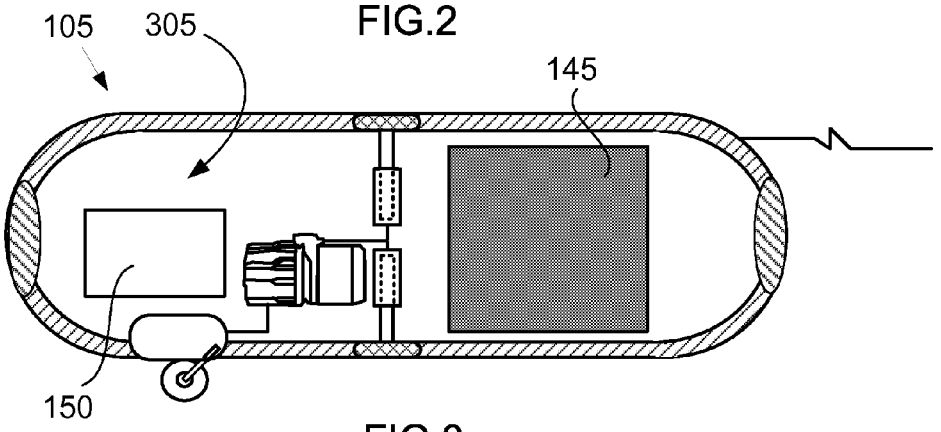
FIG. 3 is a sectional view of the embodiment of FIG. 1 that shows the interior volume of the carrier body.
Figure 4:
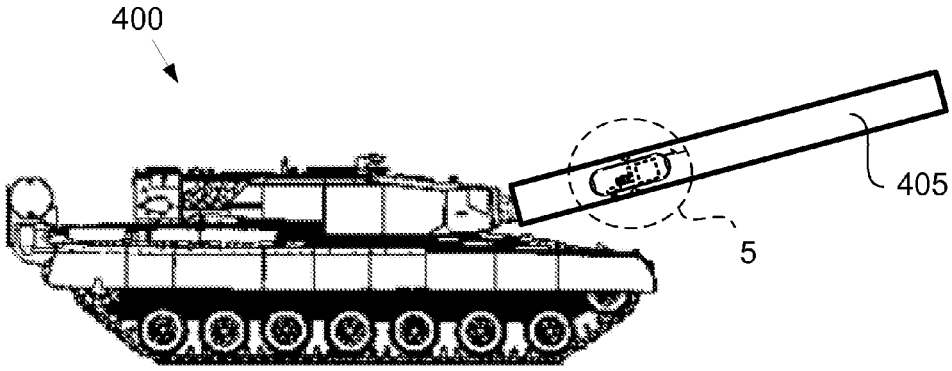
FIG. 4 is a side view of a tank with the embodiment of FIG. 1 shown in a deployed position within the tank's barrel.
Figure 6:
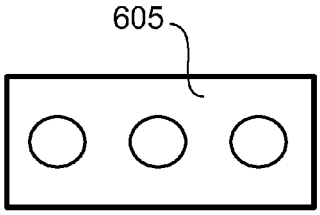
FIG. 6 is a top view of a RF remote control device.
Figure 5:
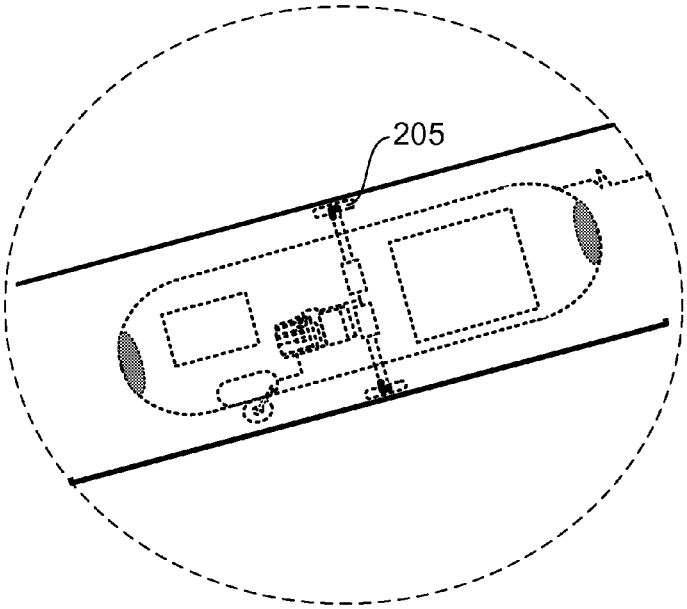
FIG. 5 is a partial view of the tank's barrel enlarged to better show the deployed position in FIG. 4.

FIG. 1 is a side elevation view of a preferred embodiment of the explosive tank barrel blocker, also referred to herein as the self-propelled explosive system (100). The self-propelled explosive system (100) is configured to fit within a barrel (405) on a tank (400), shown in FIG. 4 and FIG. 5.

The self-propelled explosive system (100) includes the following components: a carrier body (105); an explosive charge (145); a wheel (120); a foot (205); a proximity fuse (125); and a motor (130). The self-propelled explosive system (100) may further include an antenna (135), an RF remote control device (605), and a power source (150).

The carrier body (105) is essentially a vessel that defines an interior volume (305) that houses the other components of the self-propelled explosive system (100). The carrier body (105) has a front end (110) and a rear end (115). The front end (110) and the rear end (115) are designated to help define the location of components therewithin and also to define an axis connecting the front end (110) and the rear end (115) that is parallel to, or even coincident with, the centerline of the barrel (405).

The explosive charge (145) is located within the interior volume (305). This can be any of a wide variety of known explosives, such as a dynamite or plastic explosive like C4 or SEMTEX.

The wheel (120) extends from the carrier body (105) so that it can engage the barrel (405) inside-wall and propel the carrier body (105) to a position within the barrel (405) of the tank (400). There may be one or more such wheels.

The foot (205) is an extensible member that is intended to engage the barrel (405) inside-wall and firmly lock the carrier body in place within the barrel (405) by frictional contact with the barrel (405) inside wall. The foot (205) is extensible from the carrier body (105). Preferably, the foot is a hydraulic ram that makes it very difficult to move the carrier body from the position where the foot is engaged with the barrel (405). Preferably, there are two such feet on opposing sides of the carrier body (105). For this preferred embodiment, the self-propelled explosive system (100) includes the foot (205) operable to be hydraulically extensible.

The proximity fuse (125) is located at the front end (110) of the carrier body (105) and at the rear end (115) of the carrier body (105) so that any attempt to dislodge the carrier body (105) from the barrel (405) will be met with an explosion, preferably one that deforms and disables the barrel (405).

The proximity fuse (125) is connected to the explosive charge (145) so that once the proximity fuse (125) is activated, any object moved to within a specified distance from the proximity fuse (125) will ignite the explosive charge (145).

Activation of the proximity fuse (125) may be by an automated system such as after a period of time after placement in a barrel (405), or after a particular event, such as deployment of the foot (205), or by receiving a radio-frequency signal, such as from a RF remote control device (605). The automation is preferably implemented with a central processing unit or control card that is programmed to control the components of the self-propelled explosive system (100) to operate in accordance with the disclosure herein.

For the embodiment employing control by a radio-frequency signal, an antenna (135) is mounted so as to be operable to receive radio-frequency signals (140). The radio-frequency signals (140) or other light signals may be used, for example, for activation of the proximity fuse (125) and for control of the other components, such as the foot (205), the motor (130) and the movement of the wheel (120). For this embodiment, the motor (130), the wheel (120), and the proximity fuse (125) are controllable by such signals and the proximity fuse (125) may be de-activated using such signals. A RF remote control device (605), or other signal generator, may be employed to send the signals.

The motor (130) is operably connected to the wheel (120) to rotate the wheel (120) and propel the carrier body (105) within the barrel (405). The motor (130) is also configured to extend the foot (205) from the carrier body (105) to press against the barrel (405) and lock the carrier body (105) in place. Preferably, the motor operates a hydraulic system that extends the foot (205). Such hydraulic system would generate considerable force to prevent movement of the carrier body (105) once the foot (205) is extended against the barrel (405) inside-wall.

Thus, the self-propelled explosive system (100) may further include an antenna (135) to receive radio-frequency signals (140) for control of the components within the self-propelled explosive system (100), an RF remote control device (605) to send RF signals controlling the components, and a power source (150), such as a battery or capacitor, to power the motor (130) and other components.

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the weapons industry.

What is claimed is:

1. A self-propelled explosive system configured to fit within a barrel on a tank, the self-propelled explosive system comprising:

a carrier body defining an interior volume, a front end, and a rear end;

an explosive within the interior volume;

a wheel extending from the carrier body;

a foot extensible from the carrier body;

a proximity fuse at the front end and the rear end, the proximity fuse connected to the explosive so that once the proximity fuse is activated, any object moved to within a specified distance from the proximity fuse will ignite the explosive;

a motor operably connected to the wheel to rotate the wheel and propel the carrier body within the barrel, the motor configured to extend the foot from the carrier body to press against the barrel and lock the carrier body in place.

2. The self-propelled explosive system of claim 1, further comprising an antenna operable to receive radio-frequency signals, wherein the motor, the wheel, and the proximity fuse are controllable by the radio-frequency signals.

3. The self-propelled explosive system of claim 1, wherein the foot is hydraulically extensible.

* * * * *